United States Patent [19]

Shoemaker et al.

[11] 4,113,511

[45] Sep. 12, 1978

[54] LIQUID ADDITIONS TO FUSED CHEMICAL BATHS

[76] Inventors: Robert H. Shoemaker, 1327 Northwood Blvd., Royal Oak, Mich. 48073; William G. Wood, 274 Kercheval, Grosse Pointe Farms, both of Mich. 48236

[21] Appl. No.: 759,763

[22] Filed: Jan. 17, 1977

[51] Int. Cl.[2] ..... C23G 1/28; B01F 1/00

[52] U.S. Cl. ..... 134/10; 203/90; 203/100; 423/DIG. 12; 423/658.5

[58] Field of Search ..... 423/658.5, 659 A, 659, 423/DIG. 12; 203/90, 100; 159/48 L; 134/10

[56] References Cited

U.S. PATENT DOCUMENTS

| | | | |
|---|---|---|---|
| 2,022,037 | 11/1935 | Hanchett | 423/DIG. 12 |
| 3,344,042 | 9/1967 | Hardesty | 203/100 |
| 3,642,583 | 2/1972 | Greenberg et al. | 423/DIG. 12 |
| 3,702,807 | 11/1972 | Newson et al. | 203/100 |
| 3,871,180 | 3/1975 | Swanson | 203/100 |

*Primary Examiner*—Herbert T. Carter

[57] ABSTRACT

A method and apparatus is disclosed where aqueous solutions of chemicals are added to fused non-aqueous baths. This is done by spraying the aqueous solution of the chemicals onto the surface of the fused bath in a fine spray, causing the evaporation of the water.

6 Claims, 1 Drawing Figure

LIQUID ADDITIONS TO FUSED CHEMICAL BATHS

BACKGROUND OF THE INVENTION

This invention relates generally to fused chemical baths having means to supply make up chemicals in solution thereto, and more particularly to means and apparatus for utilizing chemicals in solution as additions to fused chemical metal treating baths.

There are many processes where fused essentially nonaqueous chemical baths are utilized, and to which make up chemicals must be added periodically. One particular process is that which utilizes fused baths for treating metal for scale removal, or other surface conditions. In these processes, it is necessary to periodically add more chemicals to maintain the bath, making up for depletion due to drag out, chemical utilization, evaporation, and other bath losses. Conventionally this make up chemical material is added in granular, or flake, or other similar solid form, either as a mixture of the desired chemicals, or as a solid solution.

It has long been recognized that there could be substantial benefits if the make up chemical could be supplied in liquid form, but this has not been feasible here-to-for. It is just technically and economically not feasible to maintain and supply the make up material in fused anhydrous form; and, aqueous solutions of the material, if added to a fused bath above 100° C., will result in an "explosion" due to the vaporization of the water into steam. However, liquid additions would afford close control of composition, essentially continuous addition, as well as many other benefits.

SUMMARY OF THE PRESENT INVENTION

According to the present invention a method and apparatus for adding a solution of make up chemicals to a fused chemical bath is provided. Nozzle means are disposed to spray liquid droplets above the fused bath; and a solution of the chemical, preferably an aqueous solution is maintained in a separate supply tank. The liquid solution is delivered to the nozzle means and sprayed as fine droplets above the bath. The heat from the bath vaporizes the liquid solvent, and allows the remaining chemical to enter the bath free of solvent.

DESCRIPTION OF THE DRAWING

The single FIGURE as a transverse sectional view somewhat diagramatic showing a fused chemical metal treating bath having apparatus for liquid addition of make up chemicals.

DESCRIPTION OF THE PREFERRED EMBODIMENTS

Figure 1:
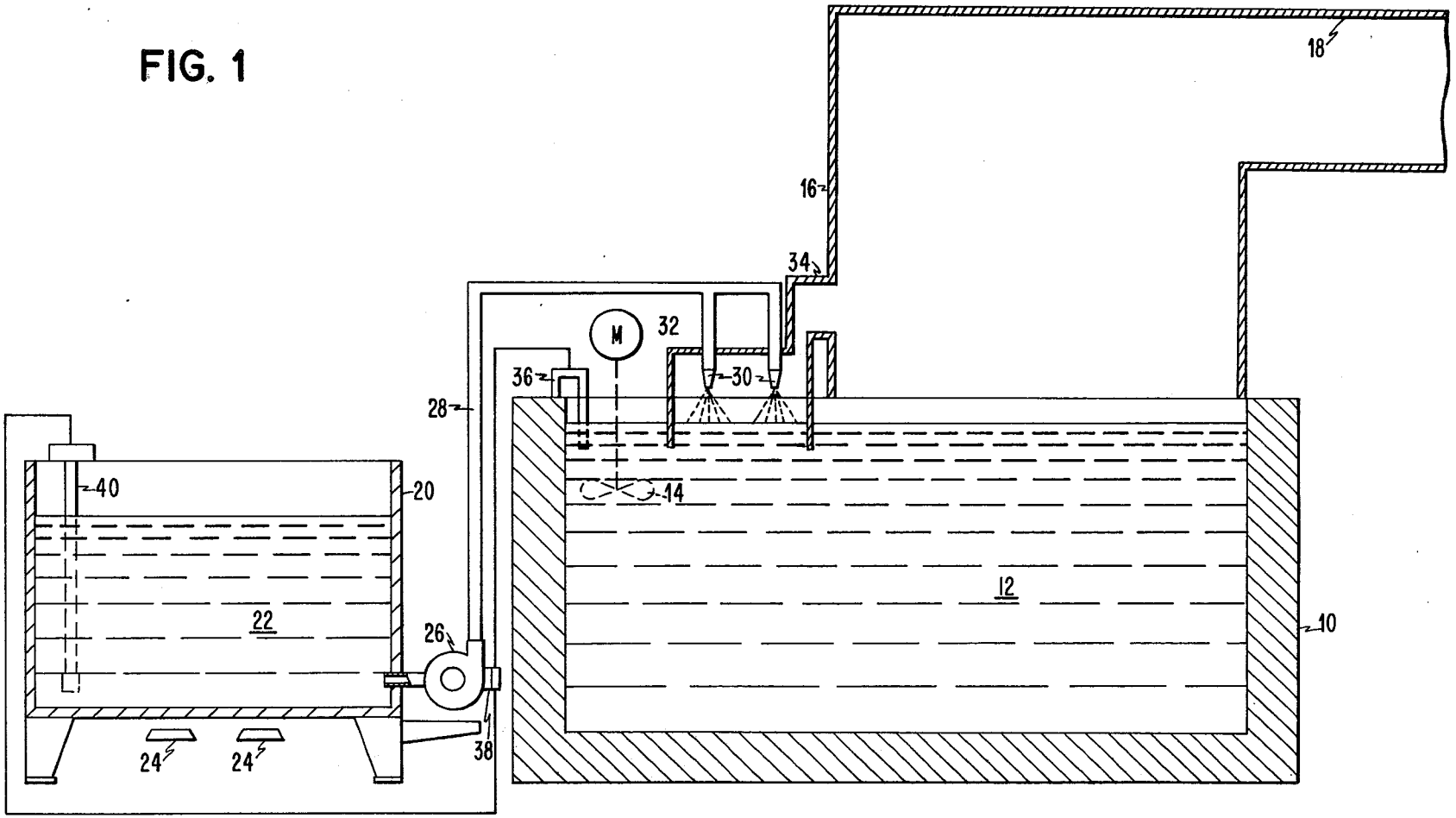

Referring now to the drawing, a fused chemical treatment main tank 10 is shown somewhat schematically adapted to treat the surface of metal for scale conditioning.

The tank 10 contains therein a fused essentially anhydrous chemical bath 12 which is maintained well above 100° C. in the fused state by any conventional heating means (not shown). A motor driven impeller 14 is provided to agitate the bath. This is located in the region at which the addition of the chemical is to be made. A main venting hood 16 is provided over the tank to collect fumes from the tank which are exhausted through exhaust duct 18. The associated processing equipment is not shown.

Apparatus for supplying a liquid solution of make up chemicals includes a supply tank 20 in which is disposed an aqueous solution 22 of the make up chemical. Burners 24 may be supplied to control the temperature and prevent solidification. A metering pump 26 is provided which pumps the solution 22 from the tank 20 through pipe or conduit 28 to nozzles 30. The nozzles 30 are disposed above the bath 12 and are configured to spray fine droplets of liquid over the surface of the bath 12.

A hood 32 surrounds the nozzles 30, and preferably projects below the surface of the bath 12.

If desired a liquid level sensor 36 is provided in the bath 12 which has feed back circuitry 38 to control operation of the pump 26 responsive to the level of the bath 12. Also a liquid level sensor 40 is provided to control the pump 26 responsive to the level of the liquid in the tank 20.

In operation, an aqueous solution of the chemical which is utilized in the bath is maintained in the tank 20. As more chemical is needed in the bath 12 the pump 26 pumps the aqueous solution to the nozzles 30. The nozzles can be any of a variety of conventional designs which will cause a fine spray of droplets to be emitted. The droplets will be exposed to the heat of the bath directly above it and the water will be vaporized into steam collected by the hood 32 and conveyed to the hood 16 through duct 34. The hood 32 prevents splattering. The impeller 14 insures mixing of the added chemical. The chemical remaining after vaporization of the water will fall onto the surface of the bath, and the impeller will immediately mix it with the bath.

There are many advantages of the system of the present invention. With this type of addition the concentration and composition of the make up chemical solution can be quickly and easily controlled or changed to meet changing requirements of make up additions. Also the additions can be made substantially continuously, thus assuring a smooth even operation of the bath free of sudden large additions of materials which can change composition and temperature when done in conventional dry mix additions.

In another embodiment, separate tanks could be connected to separate nozzles. This would allow even closer control by supplying different components of the bath separately. This can be of benefit if one component needs to be added at a different rate than another. It also can be of benefit if the components when mixed do not readily form a suitable aqueous solution but separately do. This allows for their easy addition.

Of course the invention is not limited specifically to the fused bath system shown, but can be used to add any solution of chemicals to a fused bath at a higher temperature.

I claim:

1. A method of introducing a soluble chemical composition into an essentially non-aqueous fused chemical bath of which said composition constitutes a dissolved constituent, and wherein material to be treated is periodically introduced and removed from the bath, comprising the steps of, dissolving said chemical composition in a volatile solvent having a boiling point less than the temperature of said bath, providing spray nozzle means disposed to spray liquid droplets above said bath, and spraying said dissolved composition from said nozzle means above said bath in droplet size sufficiently small to allow said solvent to evaporate before said sprayed composition impinges on the surface of said bath, and agitating said bath, whereby the solvent will evaporate and the composition will enter the bath and become mixed therewith essentially free of volatile solvent.

2. The invention as defined in claim 1 wherein the solvent is water and the bath is maintained above 100° C.

3. The invention as defined in claim 2 wherein the dissolved composition is maintained in a tank and pumped therefrom to said nozzle means.

4. The invention as defined in claim 1 further characterized by hood means disposed above said bath, and wherein said spray is directed within said hood means.

5. The invention as defined in claim 1 further characterized by controlling the rate of spray to maintain a given bath level.

6. The invention as defined in claim 1 further characterized by a plurality of nozzles, and means to supply different dissolved compositions to at least two different nozzles, and supplying different compositions from at least two different nozzles, whereby the components of a bath are separately added.

* * * * *